United States Patent [19]

Dittrich

[11] Patent Number: 4,512,532

[45] Date of Patent: Apr. 23, 1985

[54] YARN LIMITING DISC DEVICE

[76] Inventor: Horst Dittrich, Industriestrasse 9, 6382 Friedrichsdorf, Fed. Rep. of Germany

[21] Appl. No.: 529,876

[22] Filed: Sep. 6, 1983

[30] Foreign Application Priority Data

Sep. 23, 1982 [DE] Fed. Rep. of Germany ..... 3235156

[51] Int. Cl.[3] ..... B65H 75/22

[52] U.S. Cl. ..... 242/116; 242/118.4

[58] Field of Search ..... 242/77.3, 77.4, 77, 242/116, 118.4–118.8; 28/190

[56] References Cited

U.S. PATENT DOCUMENTS 1,341,815 6/1920 Mossberg ..... 242/77.3
2,194,795 3/1940 Johnson ..... 242/118.8
2,928,623 3/1960 Mayhew ..... 242/77.4
3,446,455 5/1969 Starratt ..... 242/118.8
3,565,363 2/1971 Mizuguchi et al. ..... 242/115

FOREIGN PATENT DOCUMENTS 1978197 9/1967 Fed. Rep. of Germany .
606546 12/1977 Switzerland .

*Primary Examiner*—Leonard D. Christian
*Attorney, Agent, or Firm*—Wenderoth, Lind & Ponack

[57] ABSTRACT

A yarn limiting disc device for use in winding a yarn package on a yarn package carrier of a textile machine includes a substantially planar, annular disc body adapted to have extend therethrough a beam of a yarn package carrier under which a yarn package is to be wound. A plurality of hollow reinforcing ribs extend generally radially along one side of the disc body.

19 Claims, 8 Drawing Figures

Fig. 1
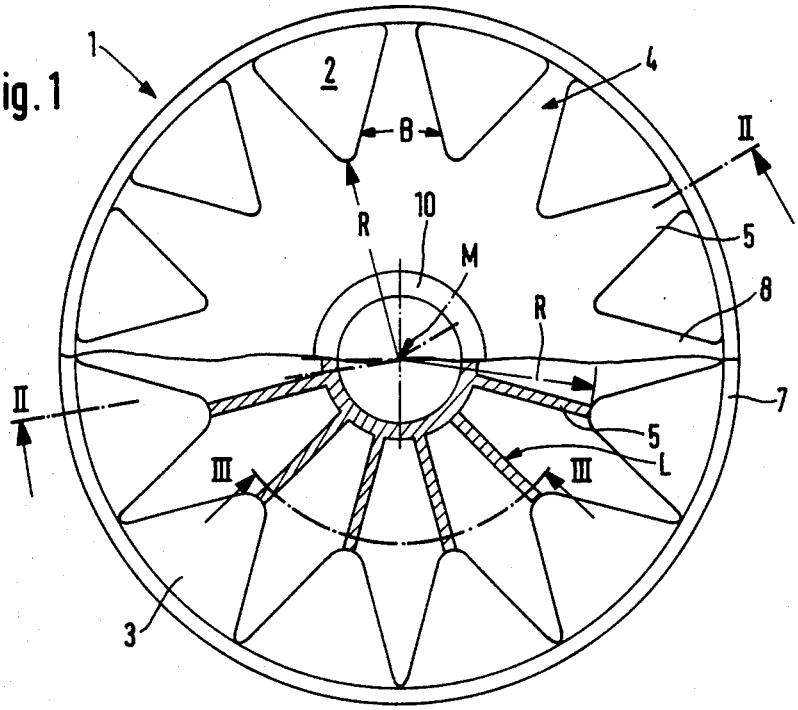
Fig. 2
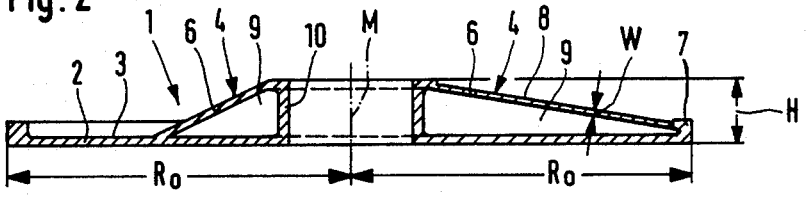
Fig. 3
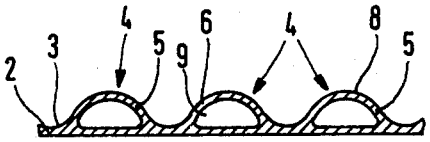
Fig. 4
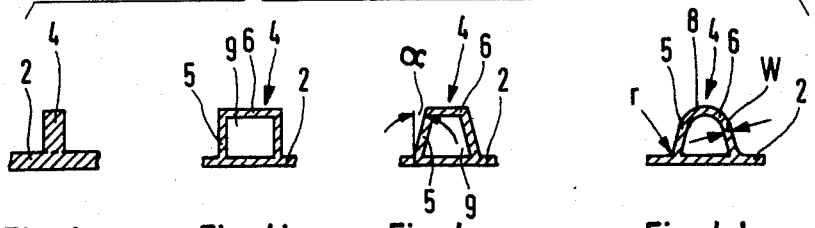
Fig. 4a Fig. 4b Fig. 4c Fig. 4d

YARN LIMITING DISC DEVICE

BACKGROUND OF THE INVENTION

The present invention relates to a yarn beam flange or a yarn limiting disc device for use in winding a yarn package on a yarn package carrier such as a loom beam, a warp beam, a weaver beam or a sectional beam of a textile machine. More particularly, the present invention is directed to such a device of the type including a generally flat disc body adapted to have extend therethrough a beam of a yarn package carrier onto which a yarn package is to be wound, with one side of the disc body being equipped with generally radially extending strengthening or reinforcing ribs. Such type of device is disclosed in West German DE-GM No. 1,978,197.

However, such known devices suffer from certain inherent disadvantages. For example, the considerable compressive forces generated during the winding of plastic yarns or yarns mixed with plastic act on the yarn flange or yarn limiting disc device and cause a bending stress thereto. This stress must be absorbed by the device with minimum deformation and be transmitted to the yarn beam extending through the device. This is led to a large variety of types of constructions, the aim of which always is to minimize the net weight of the device with maximum loading capacity and, thereby a maximum utilization of the material of the device. The load on the disc device is not even over the entire surface of the device radially, but increases constantly from the outer edge or periphery to the inner edge or periphery of the device. Thus, the radially inner area of the disc device may be subjected to yarn pressure per unit area up to three times that at the radially outer area of the disc device. This at least partially is due to the fact that the yarn forces of the yarn package act not only axially, but also radially, and the radial forces increase with the yarn package winding operation. These forces include axial and radial forces, thereby increasing the axial load at the inner area of the disc device.

The yarn limiting disc device in the past has been provided with external reinforcements to absorb all of these forces. This however has required a very strong and solid structure, both of the planar disc body and of reinforcements in the form of ribs and strips in order to maintain a satisfactory section modulus or moment of resistance. This however has resulted in a heavy net weight of the disc device with unfavorable material utilization. The dimensions grow significantly with increasing disc cross section, because the forces exerted by the yarn increase correspondingly as a result of increased quantities of yarn being wound, such quantities increasing by a factor of the square of the cross section of the disc. Consequently, due to the fact that the axial height of the disc device generally is limited or fixed, the suction modulus or moment of resistance of increased size disc devices will not be sufficient to absorb the resultant forces.

In addition, although it is necessary to accept a slight deformation of the disc device, the extent of bending or deformation of the disc device must not be of an amount to allow the outermost yarn layers to slide or slough off the wound yarn package over the disc device, since otherwise the entire yarn package would have to be rejected.

In known constructions of yarn limiting disc devices, the reinforcing ribs are solid. It further is known, such as disclosed in Swiss Pat. No. 606,546, to provide the solid reinforcing ribs in the interior of a cavity formed by a double-wall warp beam disc body. However, even this type of structure has proved to have only limited strength.

SUMMARY OF THE INVENTION

With the above discussion in mind, it is the object of the present invention to provide a yarn limiting disc device having a construction such that, without increasing the overall axial height of the device, it is possible to provide a greater section modulus or moment of resistance, thereby enabling the absorption of increased yarn compression forces, with better bending performance, with the end result being a yarn limiting disc device which may be provided with increased diameters, compared with prior art such devices.

The above object is achieved in accordance with the present invention by the provision that the reinforcing ribs extending generally radially along one side of the disc body are of hollow construction. Accordingly, the novel concept of the present invention provides a feature that heretofore has been avoided, since it previously has been believed in the industry that the reinforcing ribs had to be designed and constructed as solidly as possible.

The hollow ribs of the present invention enclose with the disc body reinforcing rib cavities and form a profile which, compared with known rib profiles, and with the same expenditure of material and weight and the same dimensions, has a suction modulus or moment of resistance which is 2.3 to 2.5 times greater than in known constructions. In the order of the same degree of magnitude, there also may be an increase in the loading capacity and bending strength of the disc device of the present invention. Due to the higher section modulus or moment of resistance achieved by the disc device of the present invention, it is possible to provide the device with a correspondingly large diameter without being unduly loaded by the correspondingly greater quantity of yarn being wound. Accordingly, the yarn limiting disc device of the present invention increases the yarn winding capacity of the relevant carrier beams employed, thereby leading to a considerable economic advantage during textile manufacture. At the same time, the hollow ribs of the present invention extend to the outer edge of the disc body, thereby providing greater rigidity at the outer area of the device, and greater resistance to abnormal loads, such as shocks, which might occur during the manufacturing process, such shocks frequently occurring in the transverse and radial directions and, in the case of known disc devices, often causing breakage of the device.

In accordance with one embodiment of the present invention, the ribs are formed by walls having edges joining the disc body. The edges of the walls of adjacent ribs are connected generally radially over a portion of the radial length of the adjacent ribs, thereby providing the disc device with suitable bending strength.

The axial height, width and/or wall thickness of the reinforcing ribs may be variable radially of the ribs, thereby to adapt the bending behavior of the disc device to particular conditions.

In accordance with a preferred embodiment of the present invention, the width of each rib increases radially outwardly from an inner portion or periphery of the disc body to a predetermined radius of the body, and the width of each rib then decreases radially outwardly from the predetermined radius to an outer portion or periphery of the body. This construction has proved to be quite satisfactory, with the adjoining edges of adjacent ribs extending substantially radially or only at a slight angle with respect to the radial direction. Preferably, the predetermined radius is from one-third to two-thirds of the total radius of the disc body.

The axial height and wall thickness of the reinforcing ribs may decrease radially outwardly.

In accordance with a further feature of the present invention, the walls of the ribs may have various configurations. For example, the rib walls may join the body transversely to the one side thereof. In a more preferable arrangement, the rib walls may extend obliquely to the one side of the body. This reduces turbulent flow and noise generation, the danger of accidents when the disc device is rotating, and the deposition of dirt. However, a still further improvement is achieved if the rib walls adjoin the disc body in a smoothly curved or rounded manner to define an exterior concave curvature. The walls of the ribs thus define an undulatory outer rib surface. This reduces still further turbulent flow and noise generation, the danger of accidents and the deposition of dirt.

A particularly suitable form of construction is attained by forming, for example by casting a metal such as a light metal, the entire device as a single, unitary member. That is, the disc body and the reinforcing ribs may be integrally cast as a unitary member. The disc body and the walls of the ribs define internal rib cavities, generally extending radially. These cavities can be filled with a non-metallic material having a specific weight lower than the specific weight of the metal used to form the disc body and the rib walls. In this manner, the section modulus or moment of resistance of the device can be improved still further without unduly increasing the overall weight of the device.

In accordance with a further feature of the present invention, the disc body has extending therethrough a central opening which is adapted to receive a beam of a yarn package carrier and which defines an inner periphery. An inner flange may extend axially from the one side of the body at the inner periphery, and an outer flange may extend from the one side of the body at the outer periphery thereof, the inner flange having a greater axial dimension than the outer flange, and the reinforcing ribs extending generally radially between the inner and outer flanges.

BRIEF DESCRIPTION OF THE DRAWINGS

Other objects, features and advantages of the present invention will be apparent from the following detailed description of a preferred embodiment thereof, with reference to the accompanying drawings, wherein:

FIG. 1 is an end view of a yarn limiting disc device in accordance with the present invention, shown partially in cross section along a plane parallel to the plane of the disc device;

FIG. 2 is a cross-sectional view taken along line II—II of FIG. 1;

FIG. 3 is a partial sectional view taken along line III—III of FIG. 1; and FIG. 4 illustrates in cross section various rib constructions, FIG. 4*a* representing a known construction, and FIGS. 4*b*, 4*c* and 4*d* representing rib structures in accordance with the present invention.

DETAILED DESCRIPTION OF THE INVENTION

A yarn limiting disc device for yarn beam flange 1 according to the present invention includes a substantially planar, annular disc body 2 having therethrough a central opening adapted to receive a beam of a yarn package carrier, in a known manner, M illustrating a central axis of the disc device and such beam. The center opening defines an inner periphery of the annular disc body 2. Extending axially from one side of body 2 at the inner periphery is an inner flange 10, and extending from an outer periphery of body 2 is an outer flange 7. Inner flange 10 has a greater axial dimension than outer flange 7.

A plurality of hollow reinforcing ribs 4 extend generally radially along one side 3 of disc body 2. As is apparent from FIG. 1, the assembly of the hollow ribs 4 provides a generally star-shaped configuration.

The ribs 4 are formed by walls 5 which have edges joining the disc body 2 in the pattern shown in FIG. 1. Also as shown in the section portion of FIG. 1, the edges of walls 5 of adjacent ribs 4 are connected along generally radial lines L over a portion of the radial length of the adjacent ribs, or such wall sections join one another along such radial lines L.

The axial height H of the ribs 4 varies radially of the ribs, and as shown in FIG. 2 the axial height H decreases radially outwardly from inner flange 10 to outer flange 7 of the disc body.

The width B of each rib 4 varies radially thereof. In a preferred arrangement, particularly shown in FIG. 1, the width B of each rib 4 increases radially outwardly from an inner portion thereof, for example from inner flange 10, to a predetermined radius R of the body, and the width B then decreases radially outwardly from predetermined radius R to an outer portion of the rib, for example to outer flange 7. The predetermined radius R preferably is between approximately $\frac{1}{3}$ and $\frac{2}{3}$ of the overall radius $R_O$ of disc body 2.

In the illustrated arrangement, the thickness W of the various portions 6 of the walls 5 is constant. However, such thickness may vary radially of the ribs, and specifically the thickness may decrease radially outwardly of the ribs.

In the embodiment illustrated in FIGS. 1–3, the walls 5 adjoining disc body 2 have a concave curvature, the surfaces of ribs 4 being rounded. The ribs 4 thus together form an undulatory overall surface 8, as particularly shown in FIG. 3. Thereby, in addition to achieving a desired high section modulus or moment of resistance, the disc device 1 exhibits a favorable bending characteristic, a relatively smooth periphery in order to reduce turbulent flow and noise generation, the danger of accidents, and the deposition of dirt or debris.

FIG. 4 illustrates various rib cross-sectional configurations. Specifically, FIG. 4*a* illustrates a known solid rib construction. FIG. 4*b* illustrates a rib construction wherein walls 5 extend transversely to body 2 and define a box-shaped or rectangular internal cavity 9. FIG. 4*c* discloses an embodiment wherein the walls extend obliquely to body 2 at a small angle $\alpha$ to the perpendicular, thereby defining a trapezoid-shaped internal cavity 9. FIG. 4*d* discloses an embodiment similar to that of FIGS. 1–3, wherein the rib walls join body 2 smoothly, as by means of exterior radius of curvature r, the walls being rounded to form the undulatory surface 8. It is to be understood however that other possible constructions and configurations of hollow ribs 4 are intended to be within the scope of the present invention.

Furthermore, a particularly advantageous arrangement of the present invention provides that the disc body 2, flanges 10 and 7, and ribs 4 are integrally formed as a single, unitary member, for example by casting a metal such as a light metal. It furthermore is contemplated in accordance with the present invention that the internal cavities 9 be filled with a non-metallic material having a specific weight lower than the specific weight of the material of the body and ribs.

Although the present invention has been described and illustrated with respect to preferred features thereof, it is to be understood that various changes and modifications may be made without departing from the scope of the present invention.

I claim:

1. A yarn limiting disc device for use in winding a yarn package on a yarn package carrier such as a loom beam, a warp beam, a weaver beam or a sectional beam of a textile machine, said device comprising:

a substantially planar, annular disc body adapted to have extend therethrough a beam of a yarn package carrier onto which a yarn package is to be wound;

a plurality of hollow reinforcing ribs extending generally radially along one side of said disc body; and said body and said ribs being integrally formed as a single unitary member defining a hollow internal cavity between said body and each said rib.

2. A device as claimed in claim 1, wherein said ribs are formed by walls having edges joining said disc body.

3. A device as claimed in claim 2, wherein said edges of said walls of adjacent said ribs are connected generally radially over a portion of the radial length of said adjacent ribs.

4. A device as claimed in claim 2, wherein the thickness of said walls varies radially of said ribs.

5. A device as claimed in claim 4, wherein said thickness decreases radially outwardly.

6. A device as claimed in claim 2, wherein the axial height of said ribs varies radially of said ribs.

7. A device as claimed in claim 6, wherein said height decreases radially outwardly.

8. A device as claimed in claim 2, wherein the width of each said rib varies radially thereof.

9. A device as claimed in claim 8, wherein said width of each said rib increases radially outwardly from an inner portion thereof to a predetermined radius of said body, and said width decreases radially outwardly from said predetermined radius to an outer portion of said rib.

10. A device as claimed in claim 9, wherein said predetermined radius is from $\frac{1}{3}$ to $\frac{2}{3}$ of the total radius of said body.

11. A device as claimed in claim 2, wherein said walls of each said rib joining said body extend transversely to said one side of said body.

12. A device as claimed in claim 11, wherein each said internal cavity is rectangular.

13. A device as claimed in claim 2, wherein said walls of each said rib joining said body extend obliquely to said one side of said body.

14. A device as claimed in claim 13, wherein each said internal cavity is trapezoid-shaped.

15. A device as claimed in claim 2, wherein said rib walls joining said body are rounded and join said body smoothly.

16. A device as claimed in claim 15, wherein said walls of said ribs define an undulatory outer rib surface.

17. A device as claimed in claim 2, further comprising non-metallic material filling said cavities.

18. A device as claimed in claim 17, wherein said material has a specific weight lower than the specific weight of the material of said body and said ribs.

19. A device as claimed in claim 1, wherein said body has extending therethrough a central opening defining an inner periphery, and further comprising an inner flange extending axially from said one side of said body at said inner periphery, and an outer flange extending from said one side of said body at the outer periphery thereof, said inner flange having a greater axial dimension from said one side than said outer flange, and said ribs extending generally radially between said inner and outer flanges.

* * * * *